United States Patent [19]

Cordes

[11] 4,295,146

[45] Oct. 13, 1981

[54] DEVICE FOR MOVING AUTOMATIC DRAWING MACHINE TOOLS

[75] Inventor: Werner Cordes, Hamburg, Fed. Rep. of Germany

[73] Assignee: Aristo Graphic Systeme GmbH & Co. KG, Hamburg, Fed. Rep. of Germany

[21] Appl. No.: 161,477

[22] Filed: Jun. 20, 1980

[30] Foreign Application Priority Data

Aug. 24, 1979 [DE] Fed. Rep. of Germany ..... 2934273

[51] Int. Cl.[3] ..... G01D 15/16

[52] U.S. Cl. ..... 346/140 R; 346/141; 346/139 A

[58] Field of Search ..... 346/139 A, 140 A, 140 R, 346/141

[56] References Cited

U.S. PATENT DOCUMENTS

| | | | |
|---|---|---|---|
| 3,149,902 | 9/1964 | Dransfield . | |
| 3,209,365 | 9/1965 | Fasola, Jr. . | |
| 3,340,541 | 9/1967 | Klassen et al. . | |
| 3,401,401 | 9/1968 | Read et al. . | |
| 3,686,681 | 8/1972 | Stegenga . | |
| 3,753,384 | 8/1973 | Anfindsen | 346/141 |
| 3,864,695 | 2/1975 | Nagashima et al. . | |
| 4,015,269 | 3/1977 | Edo . | |
| 4,054,883 | 10/1977 | Ozone | 346/141 X |
| 4,091,393 | 5/1978 | Masauyama et al. . | |
| 4,097,874 | 6/1978 | Anderka et al. | 346/141 X |
| 4,121,224 | 10/1978 | Takeuchi et al. . | |
| 4,157,552 | 6/1979 | Nakajima | 346/141 |
| 4,165,513 | 8/1979 | Flory | 346/141 |
| 4,173,021 | 10/1979 | Zuchner et al. | 346/141 X |

*Primary Examiner*—George H. Miller, Jr.

*Attorney, Agent, or Firm*—David H. Semmes; Warren E. Olsen

[57] ABSTRACT

An improved device for translational movement of automatic drawing machine tools of the type having a frame connected to a drawing machine, a permanent magnet system, and a controlling plunger attached for free movement, with respect to said frame. The plunger is interconnected to a tool carrier which accepts a writing tool in a manner wherein an electromagnetic control coil around the plunger and the tool carrier are moved by a mechanical linkage, pivoted upon said frame, so that the plunger and the carrier are simultaneously moved in opposite directions. The linkage preferably comprises a closed band, which runs around and over two deflection rollers, so that its mutually opposing and essentially parallel side portions are respectively connected to the tool carrier and the plunger. The interconnecting linkage also includes means to statically compensate for the different weights of the plunger and carrier.

11 Claims, 1 Drawing Figure

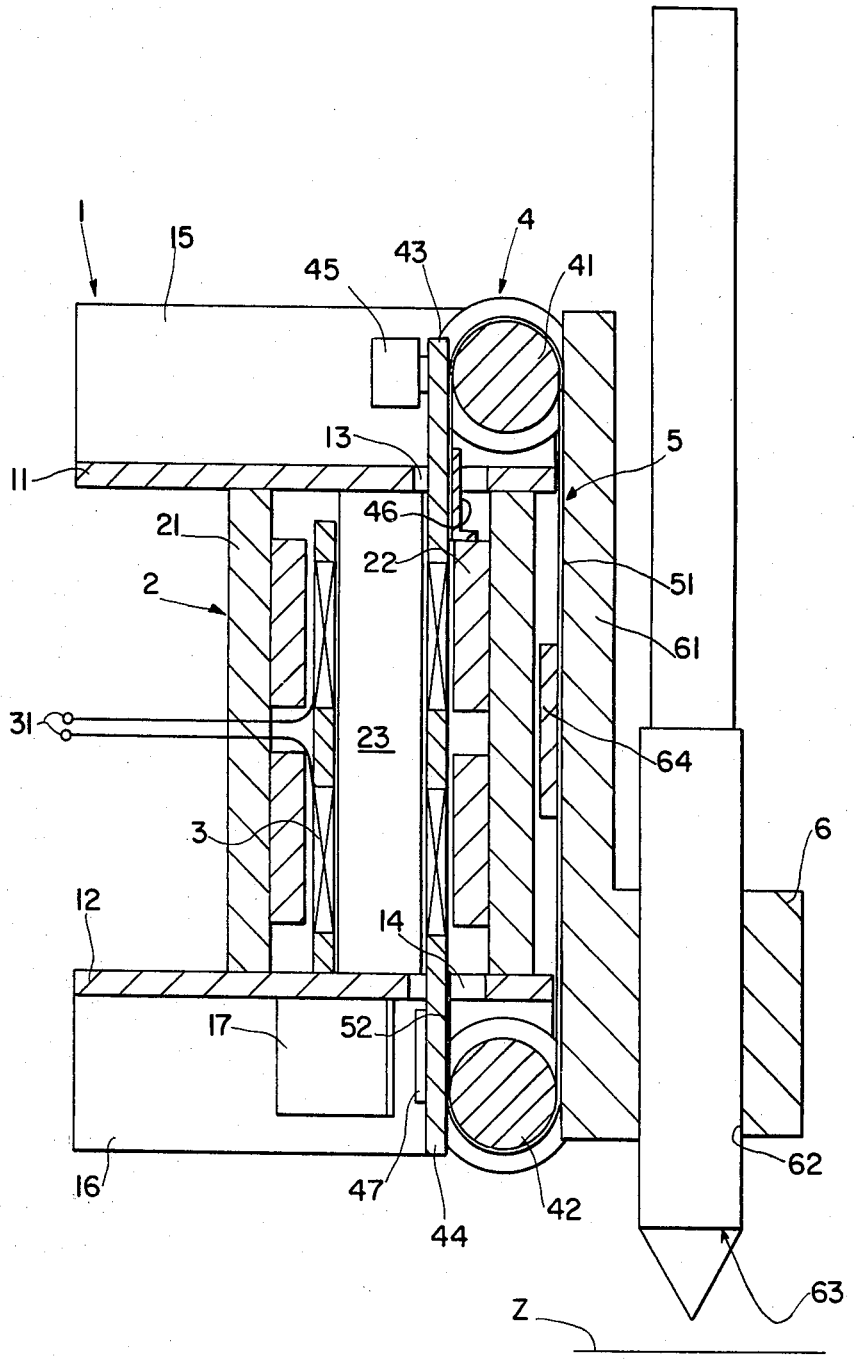
1
15
45
43
4
41
13
5
11
46
21
22
51
2
61
31
23
64
3
6
12
14
17
52
16
47
44
42
62
63
Z

DEVICE FOR MOVING AUTOMATIC DRAWING MACHINE TOOLS

BACKGROUND OF THE INVENTION

1. Field of the Invention

The invention relates to a device for translational movement of tools of automatic drawing machines, which comprises a frame capable of being connected to the drawing machine, and a permanent magnet system in which a control plunger, freely and moveably attached, is located so as to be connected to the tool carrier which accepts the tool.

2. Description of the Prior Art

With automatic drawing machines the tool, i.e., a writing pen, a drawing pen, an engraving tool, or a light drawing head, is transported over the drawing surface with corresponding longitudinal and transverse carriages. Whenever, during this positioning movement, a drawing, or line, is not to be made, the drawing tool must be elevated high enough from the drawing surface. To do this, an electromagnetically activated raising and lowering device preferrably is used.

With previously known raising and lowering devices, the tool or the tool holder which accepts the tool is connected with the plunger in coaxial alignment, so that whenever activated, considerable weight forces must be overcome. It is also a disadvantage with the previously known devices that the operation of the activation devices is dependent upon position, and when electrical power is cut off, weight forces occur which generally must be taken up by mechanical spring systems.

The present invention has as its object to improve the previously known tool raising and lowering of devices operating according to the plunger-magnet principle so that they become operational, independent of the position in which they are being used and so that no weight forces occur when electric power is shut off.

BRIEF SUMMARY OF THE INVENTION

The above-mentioned object is accomplished, according to the present invention, by connecting the control plunger to the tool carrier by means of a certain mechanical linkage, so that they are opposingly moveable and mounted in a frame. The linkages taught herein may be of a continuous or closed line, a band and track, or an equivalent lever system, with a two armed lever.

It is also contemplated that a device according to the invention, may be provided with a linkage system having counter weights, and preferably exchangeable counter weights of varying size. Hence, independent of the weight of the attached tool in its non-operational state, no weight forces will occur during the activation process.

Further details of the invention are evident from the following description, wherein reference is made to the accompanying drawing FIG. 1.

BRIEF DESCRIPTION OF THE DRAWING

The drawing FIGURE illustrates the preferred embodiment of a device according to the invention, for raising and lowering a drawing tool of an automatic drawing machine, wherein the drawing is schematic, and comprises a cut-away side view.

DETAILED DESCRIPTION OF THE PREFERRED EMBODIMENT

The tool moving device according to the invention shown in the drawing essentially comprises a frame 1, to be conventionally attached to a drawing machine, a permanent magnet system 2, a plunger 3, a band guide track 4, a guide band 5, and a tool carrier 6.

The frame 1 preferably further comprises two angled pieces whose shanks 11 and 12, are turned toward each other and between which the permanent magnet system, 2, is housed. Between the angled profile of the two shanks, 11 and 12, two permanent magnets, 21 and 22, and a magnetic core, 23, with corresponding cross-section, are disposed. The parts just mentioned can be screwed or otherwise bonded to the frame, or can be merely securely suspended. The magnetic core, 23, is surrounded by the plunger, 3, which can freely move between the permanent magnets, 21 and 22, and the magnetic core, 23.

A band and track arrangement, 4, 51, transfers the up and down movement of the plunger, 3, as initiated by means of the electrical connections, 31, to ultimately move the drawing tool, 63. Further, there are upper and lower track deflection rollers, 41 and 42, over which runs the band, 5. Two (right and left) portions, 51 and 52, of the band, 5, run parallel to one another and are connected to a vertical sliding support, 61, of the tool holder, 6, to thereby interconnect to the plunger, 3. The track band, 5, can be a steel, fabric, or plastic band, or also a chain or a toothed belt. Preferably, the sliding support, 61, has the same width as the band track rollers (41, 42), so that the free ends of support, 61, which are not securely fastened to the band, 5, can in turn also support themselves on the rollers, 41 and 42, and still allow the tool carrier, 6, to be moved. A permanent magnet, 64, is secured to the middle region of band portion, 51, to thereby further support the moving of the sliding support, 61, upon the rollers, 41 and 42. Since such a magnet, together with the permanent magnet system, 2, can together produce the desired engaging force.

Above and below the plunger, 3, counter weights, 43 and 44, are attached to left portion, 52, of the band, 5, so that these can engage against the upper surfaces of the deflection rollers, 41 and 42, in a manner similar to that of support, 61. These counter weights, 43 and 44, which are preferrably rigidly attached to the plunger carrier, function to compensate for the weight of the tool carrier, 6, which carries the actual writing-, drawing-, or engraving tool, 63, held within a receptacle, 62, as shown. To the extent that the drawing device is provided for receiving the widest variety of tools, an additional attachment can be added to the upper or lower counter weights, 43 or 44, for example. As shown an additional counter-weight, 45, is in place.

To accept the band, 5, within frame 1, the angled profile shanks, 11 and 12, of the frame have openings, 13 and 14, which allow the band, 5, and/or the counterweights attached to this portion of the band, to pass vertically through. The axes of the deflection rollers, 41 and 42, are preferably mounted within vertically extending shank portions, 15 and 16, of the frame.

In order to hold the drawing tool in a defined location when the electric power has been shut off to the plunger 3, there is illustrated the possibility of providing a stop, comprising a ferro-magnetic material, upon one of the counter weights, 43 or 44, which would make contact with the permanent magnet, 22, and would be held there with sufficient force.

As is generally customary, a positioning or sensing unit device for the drawing tool can also be attached to the activation device. In the present case, such a positioning device, 17, is located on the lower angled profile pieces, 12 and 16. This sensor unit, for example, can be a light barrier, a magneto-resistor, or something similar. The positioning device, 17, may work together with a target, 47, which can be securely fastened to the lower counter-weight, 44. A corresponding control can thereby assure that the plunger, 3, is always shut off at that instant when the drawing tool, 63, exactly touches the drawing surface, Z.

The present invention is not limited to the illustrated embodiment. It is considered also possible to substitute a lever arrangement for the closed band and track system. A two-armed lever attached to the frame 1 may take the place of the deflection roller, 41. On one end thereof a lever arm would support the plunger 3, and on the other end the tool carrier, 61. Such a guide system would also provide for a translation that defines a parallel movement of both mentioned parts. A further two-armed lever, in addition to the above-mentioned two-armed lever device, could similarly be used to replace the lower deflection roller, 42. Hence, in either case, a completely self-contained system is taught which can work almost completely independent of position, without the danger of disturbing weight forces occurring when the electric power is shut off. The plunger and the tool carrier could be attached to the two-armed lever by corresponding slot guides, which would ensure the desired relative motion. Corresponding counter-weights can also be provided, in this alternative. In addition, it is also noted as possible to make the lever arms of the two-armed lever of different lengths, so that the relatively light plunger, 3, is operated by a long lever arm, and the heavier tool carrier, 6, is operated by a short lever arm. This also makes it possible to achieve a nearly complete weight balance.

By using a closed weight compensating system, any mechanical reaction on the drawing machine while the tool is moved, and accelerated, is eliminated.

While embodiments of the invention are taught herein, they are meant to be explanatory, with the invention to be defined by the scope of the appended claims.

I claim:

1. An improved device for translational movement of automatic drawing machine tools, comprising a frame capable of being connected to a drawing machine, and a permanent magnet system, wherein a controlling plunger is attached for free movement, with respect to said frame, and said plunger is connected to a tool carrier which accepts a writing tool, wherein further, an electromagnetic control coil (3) around said plunger, is interconnected to said tool carrier (6) by means of a mechanical linkage on said frame (1), to move said plunger and carrier in opposite directions.

2. An improved device according to claim 1, wherein said mechanical linkage comprises at least one two-armed lever, which is attached to the frame (1) and also connecting the tool carrier (6) to the plunger (3), wherein the tool carrier (6) and the plunger (3) are guided to translate only parallel to one another.

3. An improved device according to claim 2, wherein the links comprising the lever arms are two-armed levers, and dimensioned essentially in inverse proportion to the weights of the plunger (3) and the tool carrier (6) carried by them.

4. An improved device according to claim 1, wherein said linkage further comprises a closed band (51) which runs around and over two deflection rollers (41, 42) whose mutually opposing and essentially parallel side portions are respectively connected to the tool carrier (6) and plunger (3).

5. An improved device according to claims 1 or 4, wherein a system (17, 47) for positioning a writing tool (63), which comprises a light and a target (17, 47), is disposed between the frame and said linkage.

6. An improved device according to either claims 1 or 4, wherein said interconnecting linkage includes means to compensate for the different weights of the plunger and carrier.

7. An improved device according to claim 6, wherein said means to compensate comprises counter-weights (43, 44) which are attached to the plunger side (51) of a closed track linkage to compensate the greater weight of the tool carrier (6).

8. An improved device according to claim 7, wherein exchangeable tools may be held in said tool carrier, wherein further attachments for additional counter-weights (45) are provided on the plunger-side portion of the said band (51).

9. An improved device according to claim 4, wherein said tool carrier (6) further comprises a sliding support (61) which is supported on said deflection rollers (41, 42) and guided for vertical movement by said rollers.

10. An improved device according to claim 9, wherein further a permanent magnet (64) is disposed upon the tool carrier (6) at a location between the deflection rollers (41, 42), and said magnet works together with a permanent magnet system (2) of said plunger (3) so as to normally urge the sliding support (61) of the tool carrier (6) against the upper surface of the deflection rollers (41, 42).

11. An improved device according to claims 1, 4 or 10, wherein a ferromagnetic stop motion device (46) is provided upon the linkage system so as to be held by a permanent magnet portion (2) of the plunger system (3), when the tool (63) is raised.

* * * * *